US005642540A

United States Patent [19]

Culver et al.

[11] Patent Number: 5,642,540

[45] Date of Patent: Jul. 1, 1997

[54] PAD COVER WITH FLAP LACKING FASTENERS

[76] Inventors: Lorraine S. Culver; Gregory B. Culver, both of 12737 Audi Ct., Boise, Id. 83713

[21] Appl. No.: 591,424

[22] Filed: Jan. 19, 1996

[51] Int. Cl.[6] ..... A47G 9/00

[52] U.S. Cl. ..... 5/499; 5/482; 5/490; 297/228.1

[58] Field of Search ..... 5/490, 470, 499, 5/501, 482, 653, 655, 738, 737; 297/219.1, 218.1; 383/84, 86

[56] References Cited

U.S. PATENT DOCUMENTS

| | | | |
|---|---|---|---|
| 1,372,270 | 3/1921 | Borland | 5/485 |
| 1,775,796 | 9/1930 | Williams | 383/86 |
| 2,066,252 | 12/1936 | Cohen, Jr. | 5/499 |
| 2,179,175 | 11/1939 | Cohen, Jr. | 5/499 |
| 2,191,963 | 2/1940 | London | 5/354 |
| 2,210,755 | 8/1940 | Frank | 383/86 |
| 2,223,568 | 12/1940 | Krasnov | 5/499 |
| 2,343,260 | 3/1944 | Leader et al. | 5/354 |
| 2,612,646 | 10/1952 | Sussman | 5/354 |
| 2,817,378 | 12/1957 | Damast | 383/86 |
| 2,879,524 | 3/1959 | Eisen | 5/354 |
| 3,583,009 | 6/1971 | Smith | 5/335 |
| 3,605,143 | 9/1971 | Smith | 5/335 |
| 5,144,911 | 9/1992 | Moore et al. | 5/470 |
| 5,323,501 | 6/1994 | Kuhangel | 5/499 |
| 5,430,902 | 7/1995 | Lewis | 5/490 |

FOREIGN PATENT DOCUMENTS

| | | | |
|---|---|---|---|
| 543264 | 8/1922 | France | 5/490 |
| 49106 | 11/1909 | Switzerland | 5/501 |

*Primary Examiner*—Alexander Grosz

*Attorney, Agent, or Firm*—David L. Volk; Brendan B. Dix

[57] ABSTRACT

A cover includes a top panel and a bottom panel configured to encase a generally rectangular pad, leaving an opening at a first end of the cover. The cover further includes a flap having a communicating edge between the flap and the top panel, the communicating edge being positioned at the first end of the cover. The flap includes two sides substantially parallel to each other at the communicating edge, the sides extending in parallel relationship to each other for a distance at least equal to the thickness of the pad, the sides then extending in converging relationship toward a distal end of the flap.

2 Claims, 4 Drawing Sheets

PAD COVER WITH FLAP LACKING FASTENERS

BACKGROUND—FIELD OF INVENTION

This invention relates to covers for pads, specifically for pads used in playpens, playyards, cribs or changing tables.

BACKGROUND—DESCRIPTION OF PRIOR ART

The conventional playpen pad cover of the prior art consists of a sheet of fabric which covers the entire top surface of the pad and the four sides. The sheet is held on the pad using elastic sewn to the sheet at each of the four corners. This cover is easily placed on the playpen pad. Unfortunately, it is also easily pulled off of the playpen pad by the baby in the playpen.

Babies often pull at the cover until one or more corners of the cover are pulled free from the pad. This defeats some of the purposes of the cover, which are to provide a clean and sanitary environment for the baby, and to provide a washable surface which protects the pad from soiling. An additional disadvantage is that the baby can become tangled in the partially removed cover.

If the cover of the prior art should become slightly soiled or wet, the entire cover must be removed and laundered, and a second cover must be placed on the pad in the meantime.

Accordingly, there is a need for a playpen pad cover which a baby cannot easily pull off of the pad. There is also a need for a playpen pad cover which covers both broad sides of the pad, so that the entire pad can be turned over if one surface of the cover becomes slightly soiled or wet, thereby exposing a clean surface to the baby.

The prior art includes several examples of mattress covers which cover both broad sides of a mattress, and which may be difficult for a baby to remove from a playpen pad, if indeed these inventions were adapted to cover a playpen pad. The problem with many of these covers is that they rely on a complicated configuration of fabric which constitutes the closure of the cover. This complicates the use and the manufacture of the cover.

Other prior art covers rely on a multitude of fasteners or a long zipper to securely close the cover about the mattress. The multitude of fasteners require extra time to fasten, and the long zipper is cumbersome to operate and may snag.

OBJECTS AND ADVANTAGES

Accordingly, several objects and advantages of the present invention are:

(a) to provide a pad cover which a baby cannot easily pull off of the pad;

(b) to provide a pad cover which covers both broad sides of the pad so that the entire pad can be turned over if one surface of the cover becomes slightly soiled or wet, thereby exposing a clean surface to the baby;

(c) to provide a pad cover which is simple to use and manufacture due to its simplicity of configuration; and (d) to provide a pad cover which can be secured about the pad simply, easily and quickly without snagging.

SUMMARY

The present invention is a cover for pads used with playpens, playyards, cribs or changing tables. The cover comprises a top panel and a bottom panel configured to encase a generally rectangular pad, leaving an opening at a first end of the cover.

A flap includes a communicating edge between the flap and the top panel, the communicating edge being positioned at the first end of the cover.

The flap includes two sides substantially parallel to each other at the communicating edge, the sides extending in parallel relationship to each other for a distance at least equal to the thickness of the pad, the sides then extending in converging relationship toward a distal end of the flap. The two sides meet to form an apex at the distal end.

The cover may include a single fastening means, a first part of the fastening means positioned on the flap near the distal end, and a second part of the fastening means positioned on the bottom panel of the cover in communicating relationship with the first part of the fastening means when the flap is closed over the first end of the cover.

Because the cover includes a top panel and a bottom panel which encase the pad, and because the flap extends from the top panel to the bottom panel where the flap is fastened to the bottom panel, a baby cannot easily pull the cover off of the pad.

Because the flap includes two sides which converge toward the distal end, it is possible to fasten the flap with a single fastener, and a zipper is not required. This allows the cover to be secured about the pad simply, easily and quickly without snagging.

Alternatively, if the cover does not include a fastening means, the flap should be tucked in between the bottom panel and the pad. In this case, the flap extends at least halfway along the bottom panel of the cover when the flap is tucked inside the cover. This will provide the benefit of making it difficult for the child to remove the cover from the pad, plus give the added benefit that the entire pad can be turned over if the top panel of the cover becomes slightly soiled or wet, thereby exposing to the baby a clean, smooth surface without fasteners. Because the sides of the flap converge toward the distal end, the sides of the flap do not become snagged or caught between the edges of the pad and the cover when the flap is tucked in. In this alternative embodiment, it is not necessary for the sides to meet to form an apex at the distal end.

DETAILED DESCRIPTION

Figure 1:
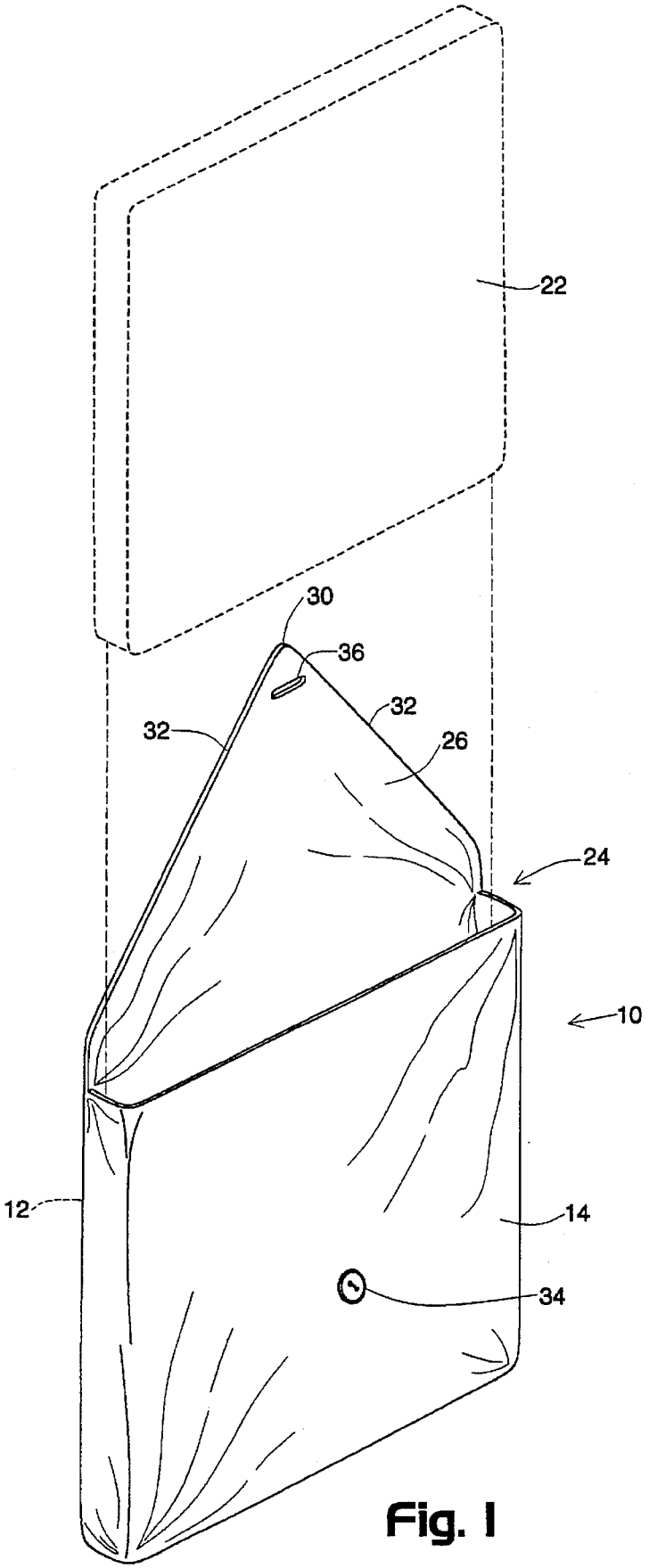
FIG. 1 is a bottom perspective view of the pad cover, shown apart from the pad, and with the flap open.
Figure 2:
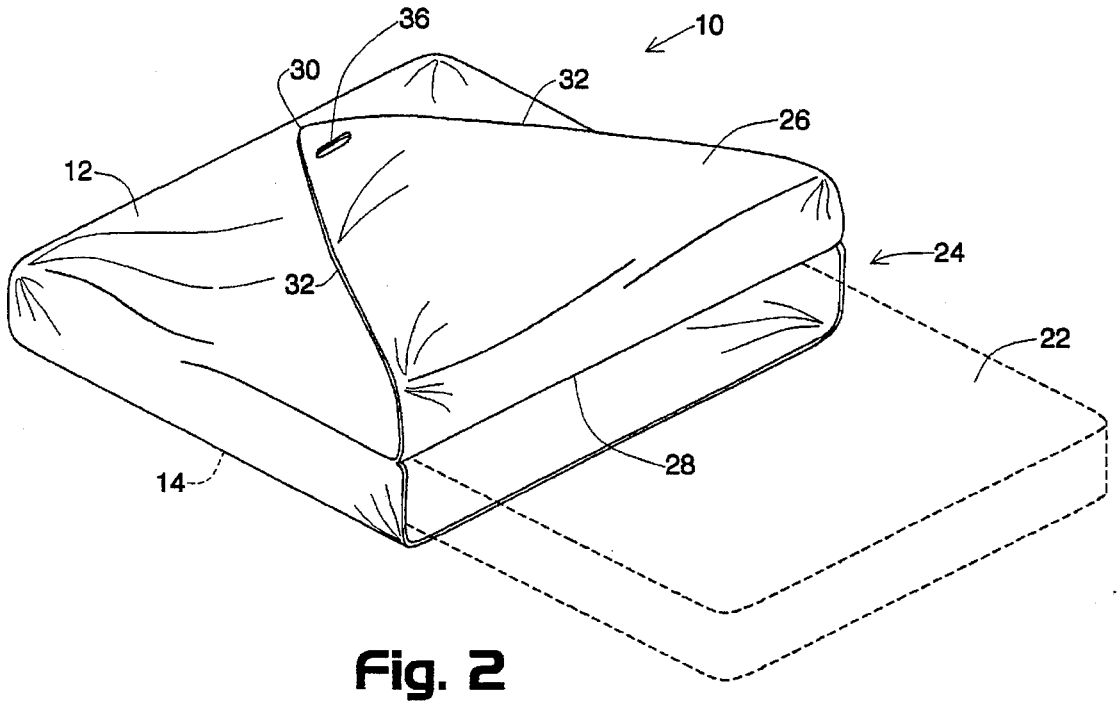
FIG. 2 is a top perspective view of the pad cover, shown with the flap pulled back and the pad partially inserted.

FIG. 1 is a bottom perspective view of a cover 10 for a generally rectangular pad 22, shown apart from the pad 22. The cover 10 includes a flap 26 which is shown open in FIG. 1. FIG. 2 is a top perspective view of the pad cover 10, shown with the flap 26 pulled back and the pad 22 partially inserted. The cover 10 includes a top panel 12 and a bottom panel 14 configured to encase the pad 22, leaving an opening at a first end 24 of the cover 10.

The flap 26 has a communicating edge 28 between the flap 26 and the top panel 12, the communicating edge 28 being positioned at the first end 24 of the cover 10.

The flap 26 includes two sides 32 substantially parallel to each other at the communicating edge 28, the sides 32 extending in parallel relationship to each other for a distance at least equal to the thickness of the pad 22, the sides then extending in converging relationship toward a distal end 30 of the flap 26.

Figure 3:
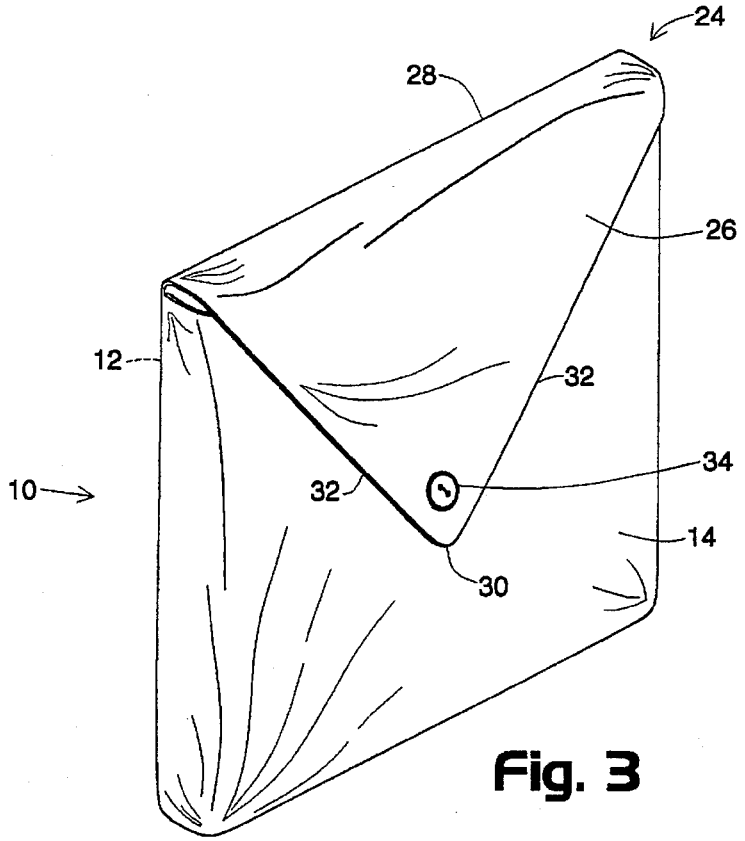
FIG. 3 is a bottom perspective view of the pad cover, shown with the pad inside and with the flap closed.

FIG. 3 is a bottom perspective view of the cover 10, shown with the pad 22 inside the cover 10 and the flap 26 closed. Referring to FIGS. 2 and 3, the cover includes a button hole 36 positioned on the flap 26 near the distal end 30. A button 34 is positioned on the bottom panel 14 in communicating relationship with the button hole 36 when the flap 26 is closed over the first end 24 of the cover 10. In order not to create a choking hazard, the button 34 is larger than an esophageal opening of a child aged three or under. As an alternative to the button 34 and the button hole 36, a hook and loop fastening system (not shown) may be used.

Figure 4:
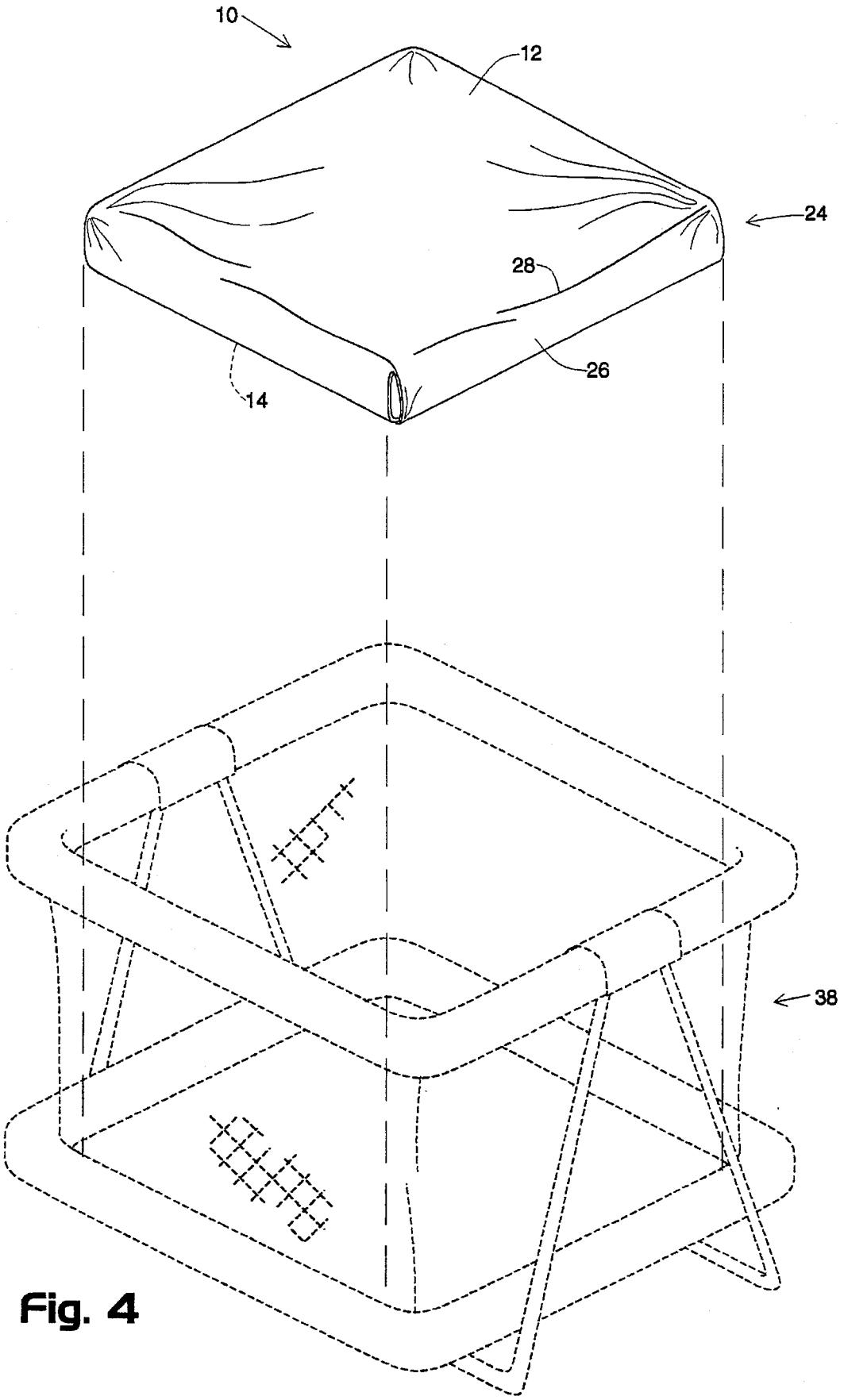
FIG. 4 is a perspective view of the pad cover with the pad inside, and a playpen in which the pad is used.

FIG. 4 is a perspective view of the cover 10 with the pad 22 inside, and a playpen 38 in which the pad 22 may be used. The cover 10 may also be used with pads 22 designed for use in playyards or cribs, or on changing tables. The cover 10 may also be used for pads 22 or mattresses of any type or for any use, for example, inflatable camping mattresses or bed mattresses.

Figure 5:
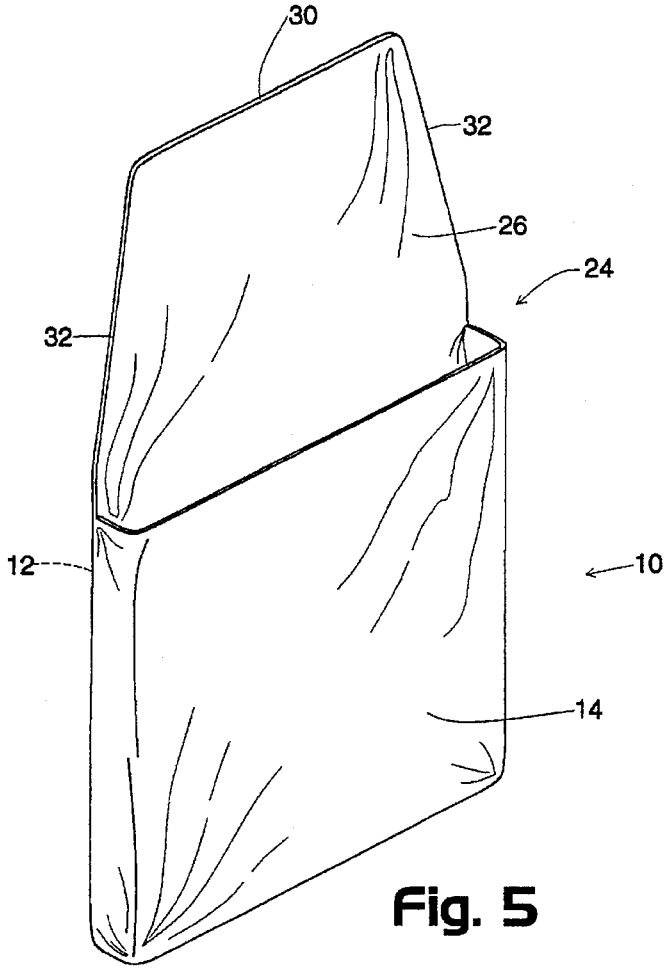
FIG. 5 is a bottom perspective view of a second embodiment of the pad cover, with the flap open.

FIG. 5 is a perspective view of a second embodiment of the cover 10, with the flap 26 open. It is similar in all respects to the first embodiment already described, except that it does not include the button 34 or the button hole 36, it is not necessary for the sides 32 to meet to form an apex at the distal end 30 of the flap 26, and the flap 26 extends at least halfway along the bottom panel 14 when the flap 26 is tucked inside the cover 10.

Figure 6:
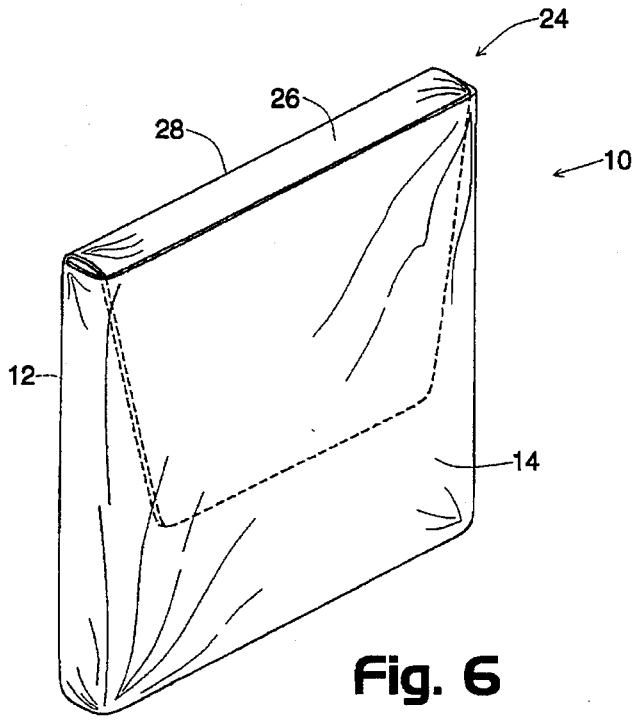
FIG. 6 is a bottom perspective view of a second embodiment of the pad cover, with the flap closed.

FIG. 6 is a perspective view of the second embodiment of the cover 10, with the pad 22 inside the cover 10. When the flap 26 is tucked inside the cover 10, between the pad 22 and the bottom panel 14, the pad 22 and cover 10 are ready for use inside the playpen 38 or elsewhere.

The cover 10 is made of any suitable fabric such as (but not limited to) cotton, nylon, cotton blend and flannel. In the second embodiment, flannel is a particularly appropriate material because the flap 26 will tend to hold to the bottom panel 14 when the flap 26 is tucked inside the cover 10.

CONCLUSION, RAMIFICATIONS AND SCOPE

Thus the pad cover of the present invention cannot be easily pulled off of the pad by a baby, can be turned over if one surface of the cover becomes slightly soiled or wet, thereby exposing a clean surface to the baby, is simple to use and manufacture due to its simplicity of configuration, and can be secured about the pad simply, easily and quickly without snagging.

While the above description contains many specificities, these should not be construed as limitations on the scope of the invention, but rather as an exemplification of some embodiments thereof. Many variations are possible.

Accordingly, the scope of the invention should be determined not by the embodiment illustrated, but by the appended claims and their legal equivalents.

The invention claimed is:

1. A cover for a generally rectangular playpen pad comprising:

a. a top panel and a bottom panel configured to encase the pad, leaving an opening at a first end of the cover;

b. a flap having a communicating edge between the flap and the top panel, the communicating edge positioned at the first end of the cover;

c. the flap including a distal end;

d. the flap having two sides, the sides substantially parallel to each other at the communicating edge, the sides extending in parallel relationship to each other for a distance at least equal to the thickness of the pad to be encased by the cover, the sides then extending in converging relationship to the distal end;

e. the flap having a distal edge at the distal end;

f. the distal edge being parallel to the communicating edge and at least half as long as the communicating edge;

g. the flap extending at least halfway along the bottom panel of the cover when the flap is tucked inside the cover; and h. the flap being devoid of fasteners, whereby the pad may be inserted into the cover, the flap may be tucked inside the cover between the bottom panel and the pad, and the pad may be placed on a playpen floor with the bottom panel and the flap positioned between the pad and the playpen floor, thus preventing a small child positioned on the pad from easily removing the cover from the pad while having no fastener which may harm the child.

2. The cover of claim 1, wherein the cover is made of flannel.

* * * * *